US009199822B1

(12) United States Patent
Pegg

(10) Patent No.: US 9,199,822 B1
(45) Date of Patent: Dec. 1, 2015

(54) SYSTEMS AND METHODS FOR FOLDING A STACK OF SUBSTRATE SHEETS

(75) Inventor: Thomas C. Pegg, West Olive, MI (US)

(73) Assignee: EXPRESS SCRIPTS, INC., St. Louis, MO (US)

( * ) Notice: Subject to any disclaimer, the term of this patent is extended or adjusted under 35 U.S.C. 154(b) by 675 days.

(21) Appl. No.: 13/252,810

(22) Filed: Oct. 4, 2011

Related U.S. Application Data

(60) Provisional application No. 61/422,683, filed on Dec. 14, 2010.

(51) Int. Cl.

| | |
|---|---|
| ***B65H 37/06*** | (2006.01) |
| ***B31F 1/08*** | (2006.01) |
| ***B65H 45/18*** | (2006.01) |
| ***B65H 45/30*** | (2006.01) |

(52) U.S. Cl.
CPC ..... *B65H 45/18* (2013.01); *B65H 45/30* (2013.01); *B65H 2301/50* (2013.01); *B65H 2801/24* (2013.01)

(58) Field of Classification Search
CPC ..... B65H 45/00; B65H 45/14; B65H 45/168; B65H 45/30; B65H 45/18; B65H 45/04; B65H 2404/612; B65H 2404/6111; B65H 2405/1114; B65B 63/04; B31F 1/08
USPC ..... 493/454, 444, 440, 419, 427, 434, 435, 493/437, 442, 445; 53/429, 120; 270/32, 41
See application file for complete search history.

(56) References Cited

U.S. PATENT DOCUMENTS

| | | | | |
|---|---|---|---|---|
| 3,747,917 | A * | 7/1973 | Roda | 493/14 |
| 3,973,373 | A * | 8/1976 | Williams et al. | 53/120 |
| 6,817,605 | B1 * | 11/2004 | Bohn | 270/37 |
| 7,152,856 | B2 * | 12/2006 | Kamiya et al. | 270/37 |
| 7,326,166 | B2 | 2/2008 | Sytema | |
| 7,489,898 | B2 * | 2/2009 | Hayashi | G03G 15/6538 399/406 |
| 8,113,499 | B2 * | 2/2012 | Kushida | B65H 29/58 270/37 |
| 2002/0025207 | A1 * | 2/2002 | Yoshie et al. | 399/407 |
| 2010/0314049 | A1 * | 12/2010 | Yamauchi | B65H 37/04 156/387 |

* cited by examiner

*Primary Examiner* — Gloria R Weeks
*Assistant Examiner* — Justin Citrin
(74) *Attorney, Agent, or Firm* — Bryan Cave LLP

(57) ABSTRACT

Systems and methods for folding a stack of substrate sheets are provided. The system may include a roller assembly and a positioning mechanism. The roller assembly is configured for folding the stack of substrate sheets and the positioning mechanism is configured to position the substrate or stack for entry into the roller assembly. The positioning mechanism includes an upper curved form and a lower curved form to guide the stack of substrate sheets into a curved position for folding. The positioning mechanism further includes a folding blade positioned to extend through the gap between the upper and lower curved forms. The roller assembly can move the folded stack of substrate sheets in at least two directions.

21 Claims, 14 Drawing Sheets

SYSTEMS AND METHODS FOR FOLDING A STACK OF SUBSTRATE SHEETS

CROSS-REFERENCE TO RELATED APPLICATIONS

This application claims priority under 35 U.S.C. §119(e) to United States Provisional Patent Application entitled "SYSTEM AND METHOD FOR FOLDING SUBSTRATES", Ser. No. 61/422,683 filed on 14 Dec. 2010, the entire contents of the application is herein incorporated by reference.

FIELD

This application generally relates to a system and method for folding a stack of substrate sheets. More specifically, this application relates to a system and method for folding a stack of substrate sheets into a stable, space-efficient folded configuration for packing and shipping.

BACKGROUND

It is common to simply fold sheets of printed material, such as an invoice, and place it into a shipping container. However, as businesses seek to lower shipping costs, shipping containers become smaller and more tailored to the size and shape of the items being shipped. Furthermore, as products become more complicated and require more instructions, warnings, legal disclaimers, and the like, the number of pages for folding, before inclusion with items in the shipping container, increases. Simply folded paperwork may not fit into the shipping container without tearing or crumpling. Furthermore, simply folded paperwork may have the tendency to unfold by itself or spring back to approximately its original size.

DETAILED DESCRIPTION

In general, systems and methods may include the use of multiple sets of opposing rollers driven by servo drives to efficiently and automatically fold sheets of the substrate material. By feeding the folded sheets through the sets of opposing rollers in one direction, and then back feeding the sheets in the opposite direction, a stepped crease having a staggered fold configuration is created. This process results in a fold with increased tightness and reduced tendency to unwind. The tighter fold may reduce the variability of the folded substrates in an automated handling process, leading to a higher degree of operational efficiency.

Figure 1:
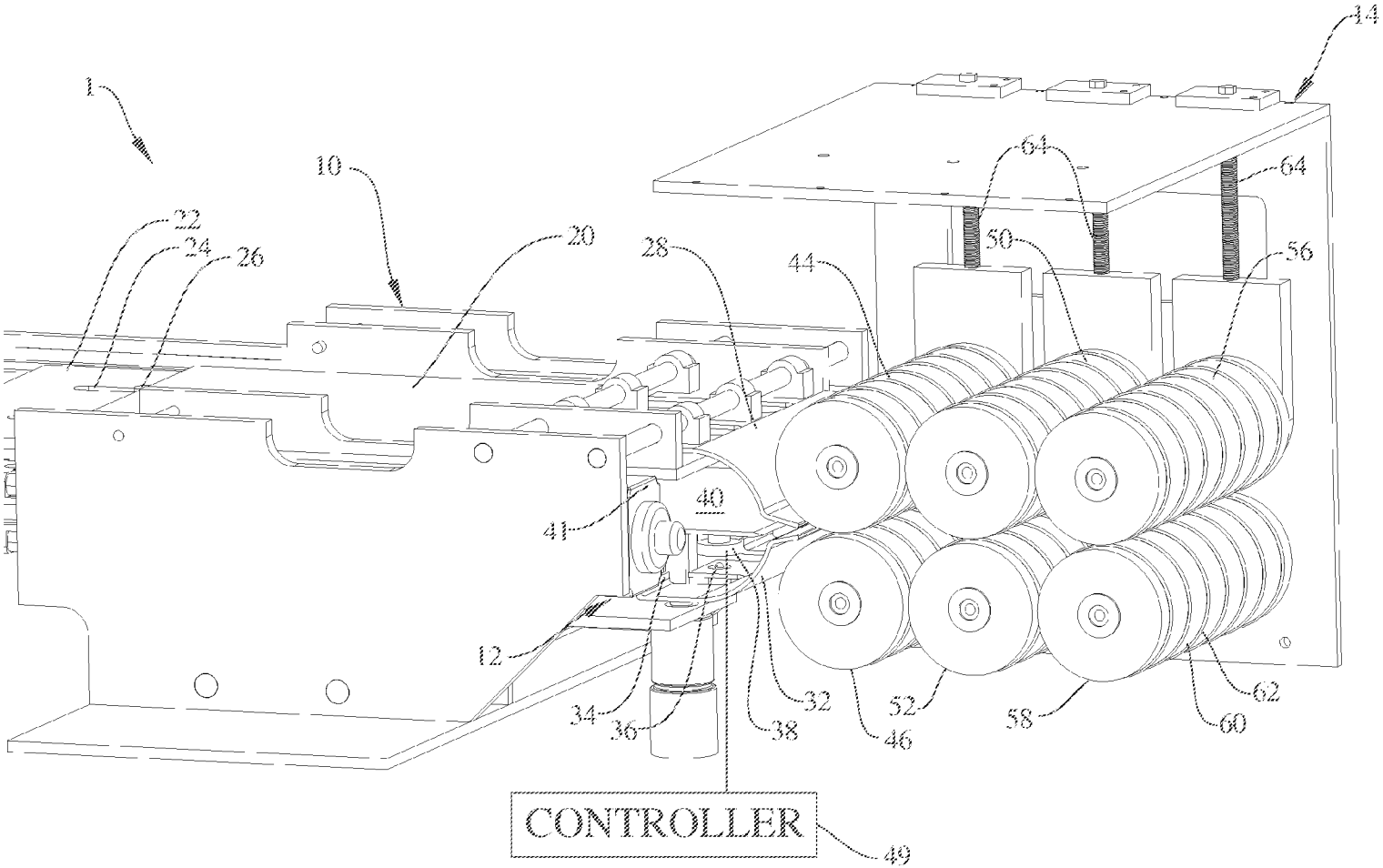
FIG. 1 is a partial side perspective view of an embodiment with some exterior structure removed for clear illustration of internal components.

FIG. 1 is an illustration of a system 1, according to an example embodiment. The system 1 and (and an associated method 500 as described in FIG. 5 below) continuously fold stacks of multiple sheets of substrates, such as paper, coated paper, printable polymers, or combinations thereof. The folded substrates may be used in a variety of different ways including for efficient packing in shipping containers. The system 1 and method 500 also effectively and automatically fold the stack of substrates into a stable space-efficient folded configuration. In some embodiments, the folded configuration is a staggered folded configuration such that the fold of each sheet in the stack does not rest exactly within or adjacent the enveloping folded sheet. Rather, the staggered folded configuration that is made by the system 1 and method 500 is a configuration of stepped creases similar to a chevron fold (e.g., Sergeant's stripes are positioned in a chevron fold) or multiple stacked chevron folds. Specifically, viewing the stack of substrate sheets in its staggered folded configuration at rest horizontally, the folded edges of the inner substrate sheets of the staggered folded configuration are slightly offset from a respective outer folded edge of the paper enveloping it.

The system 1 includes a transporting mechanism 10, a positioning mechanism 12, and a roller assembly 14. The transporting mechanism 10 receives and transports a stack of substrate sheets 20. In an example, the transporting mechanism 10 includes walls that define a receiving slot for the stack of substrate sheets 20 and may include mechanical and electrical components to transport the stack of substrate sheets 20. The positioning mechanism 12 is configured to receive the stack of substrate sheets 20 and positions the stack of substrate sheets 20 for folding. The positioning mechanism 12 also drives a portion of the stack of substrate sheets 20 into the roller assembly 14 after the stack of substrate sheets 20 is positioned for folding. As shown in FIG. 1, the transporting mechanism 10 includes a receiving tray 22 having one or more elongated slots 24 and vertical fingers 26. As used herein, directional terms such as forward, rearward, above, downward, vertical, horizontal, below and transverse, as well as any other similar directional terms, are for reference only unless explicitly recited in the claims and do not limit components of the system 1 to a specific angle. For example, vertical and horizontal need not be perpendicular to one another. Accordingly, these terms, as utilized to describe the system 1 and method 500 should be interpreted relative to the system 1 and method 500 as implemented in the normal operating position and as shown in the drawings for ease of explanation. In some embodiments, each of the vertical fingers 26 of the transporting mechanism 10 extends through one of the elongated slots 24. The vertical fingers 26 are configured to push multiple sheets from the stack of substrate sheets 20 by pushing the edges of the multiple sheets as the vertical fingers 26 slide in the elongated slots 24.

Figure 2:
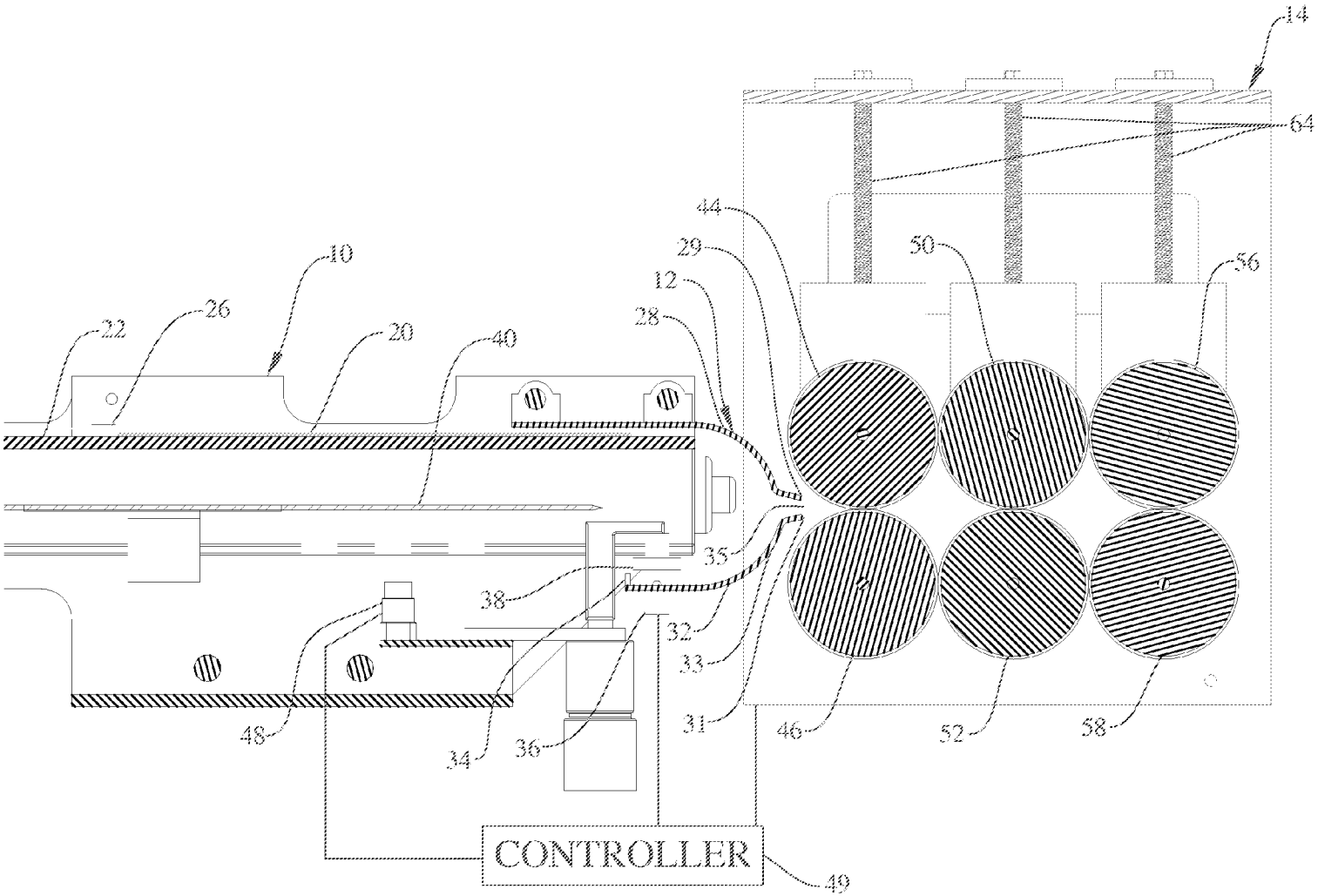
FIG. 2 is a partial cross-sectional side view of an embodiment illustrating the substrate positioned in a tray.

Referring to FIG. 2, the stack of substrate sheets 20 is manually loaded or fed by a sheet feeder (not shown) into the receiving tray 22. When a stack of the desired number of substrate sheets 20 to be folded together is accumulated in a horizontal feed position at the receiving tray 22, the vertical fingers 26 transport the stack of substrate sheets 20 by sliding along the elongated slots 24. The vertical fingers 26 are driven from end to end along the elongated slots 24 by a pneumatically-driven piston, electro-mechanical actuator or other similar mechanism. Other types of actuators may drive movement of the vertical fingers 26.

Also as shown in FIG. 1, the positioning mechanism 12 includes an upper curved form 28, a lower curved form 32, a stop 34, a position sensor 36 and a clamping mechanism 38. The lower curved form 32 is offset from the receiving tray 22 in a direction towards the roller assembly 14. The upper curved form 28 and the lower curved form 32 are disposed between the transporting mechanism 10 and the roller assembly 14. Specifically, the upper curved form 28 and the lower curved form 32 have a concave side facing the transporting mechanism 10 and a convex side facing the roller assembly 14.

Figure 3:
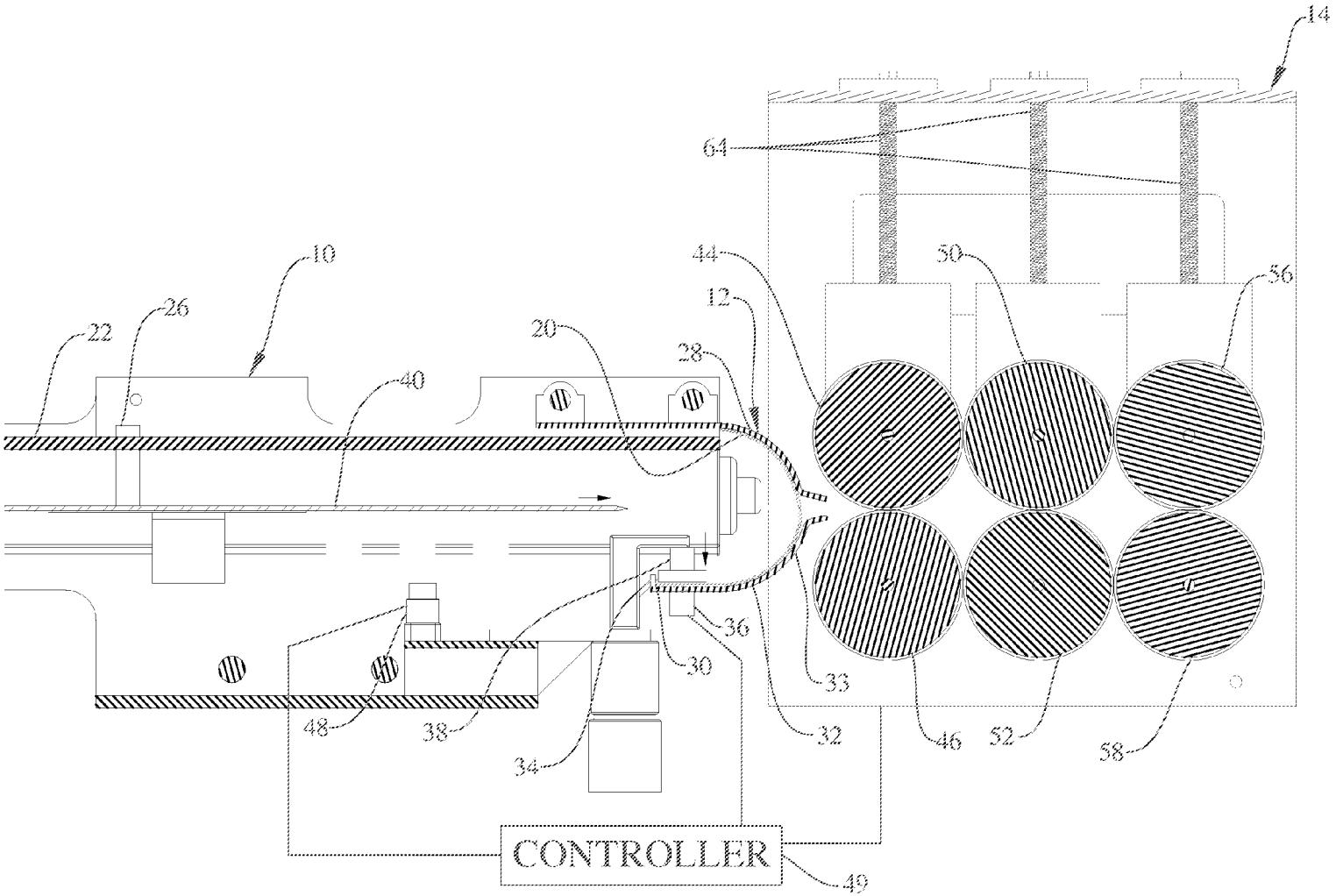
FIG. 3 is a partial cross-sectional side view of an embodiment illustrating the substrate positioned within curved forms.

As shown in FIG. 3, a leading edge 30 of the stack of substrate sheets 20 is advanced by the vertical fingers 26 of the transport mechanism 10 through the upper curved form 28, where it is deflected so as to orient the leading edge 30 of the stack 20 in a downward direction. As the stack of substrate sheets 20 is further advanced by the vertical fingers 26, the leading edge 30 contacts and is deflected by the lower curved form 32. In some embodiments, the lower curved form 32 is offset relative to the upper form 28 in a direction towards the roller assembly 14 to ensure that the leading edge 30 of the stack 20 contacts an inside curve 33 of the lower curved form 32 to facilitate transitioning of the edge 30 from the upper curved form 28 to the lower curved form 32. In an example embodiment, a free edge 29 of the upper curved form 28 is positioned closer to the vertical fingers 26 and receiving tray 22 than a free edge 31 of the lower form 32. The free edges 29, 31 of the upper curved form 28 and the lower curved form 32 are spaced from each other to form an elongated aperture 35 through which the stack of sheets can travel as will be described in greater detail herein. The free ends of the upper and lower curved forms include flanges that extend away from the receiving tray 22 and toward the roller assembly 14. The aperture 35 acts as a gap that is sized to receive there through at least twice the height of the stack of substrate sheets 20 and the blade 40. The stack of substrate sheets 20 is advanced by the vertical fingers 26 around the upper curved form 28, past the opening, onto the lower curved form 32 until the leading edge 30 reaches an approximately horizontal orientation and contacts the stop 34 at a lower end portion of the lower curved form 32.

Referring to FIG. 3, the leading edge 30 activates the position sensor 36. The position sensor 36 operates by detecting a presence of the leading edge 30 at the lower end portion of the lower curved form 32 with, for example, sonic or ultrasonic detection, pressure sensing, interruption of a light beam or physical proximity. The position sensor 36 is communicatively connected to the clamping mechanism 38, which is positioned over the lower end portion of the lower curved form 32. A signal from the position sensor 36 activates the clamping mechanism 38. The clamping mechanism 38 is driven by a pneumatically-driven piston, electromechanical device, or similar instrumentality, for example. The clamping mechanism 38 secures the stack of substrate sheets 20 against an inside surface of the lower end portion of the lower curved form 32 so that the leading edge 30 is retained in position against the lower end portion of the lower curved form 32.

Figure 4:
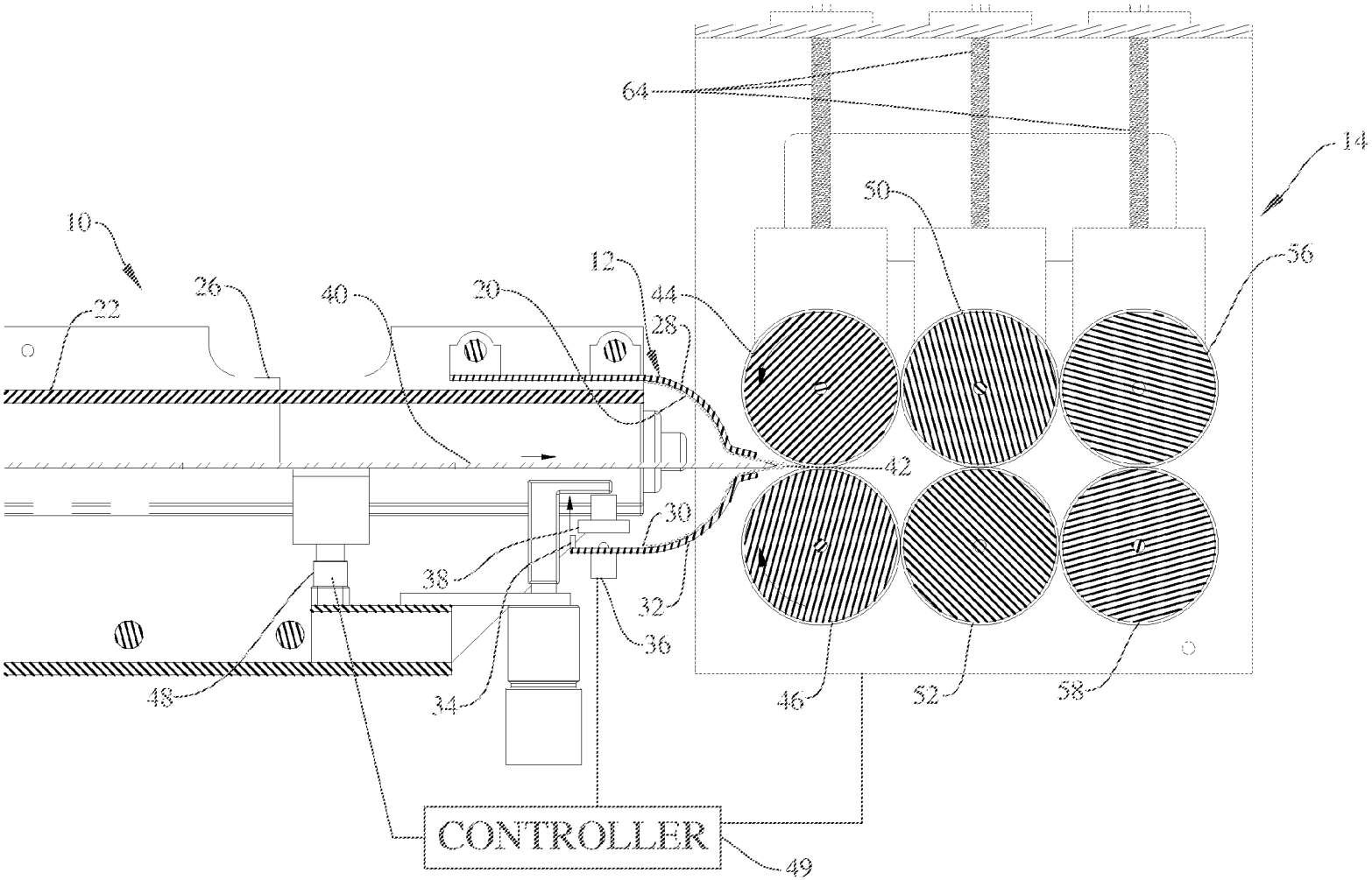
FIG. 4 is a partial cross-sectional side view of an embodiment illustrating a blade engaging the substrate.

As shown in FIG. 4, once the stack of substrate sheets 20 is secured, a blunt folding blade 40 is activated by an actuator 41 (pneumatically-driven or electrically driven) and extends horizontally to contact and push a midpoint section 42 of the stack of substrate sheets 20 into the roller assembly 14. The folding blade 40 is disposed between the tray 22 and the lower curved form 32 and is configured to slide between the upper and lower curved forms 28, 32 and through the aperture. Any blunt, narrow object that is capable of sliding between the upper and lower curved forms 28, 32 may be utilized to push the midpoint section 42 into the roller assembly 14. The mid-point section 42 may be the center of the stack of substrate sheets 20 or may be offset from the center of the stack of substrate sheets 20 in some example embodiments.

Referring to FIG. 1, the roller assembly 14 includes sets of opposing rollers 44, 46, 50, 52, 56, 58 for receiving and then folding the stack of substrate sheets 20 as it moves through the sets of opposing rollers. In some embodiments, the sets of opposing rollers 44, 46, 50, 52, 56, 58 are driven by a servo drive or drives (not shown) or other activation mechanisms to efficiently and automatically fold the stack of substrate sheets 20 by reversing direction of rotation. For example, the roller assembly 14 may include a first set of opposing rollers 44, 46 rotatably disposed to receive the stack of substrate sheets 20 therebetween. The first set of opposing rollers 44, 46 is positioned proximate the upper and lower curved forms 28, 32. The line of contact 45 between rollers 44, 46 is aligned, e.g., co-planar and essentially horizontal, with the center of the aperture 35 between the upper and lower curved forms 28, 32 and first receives the stack of substrate sheets 20 in the roller assembly 14.

Figure 5:
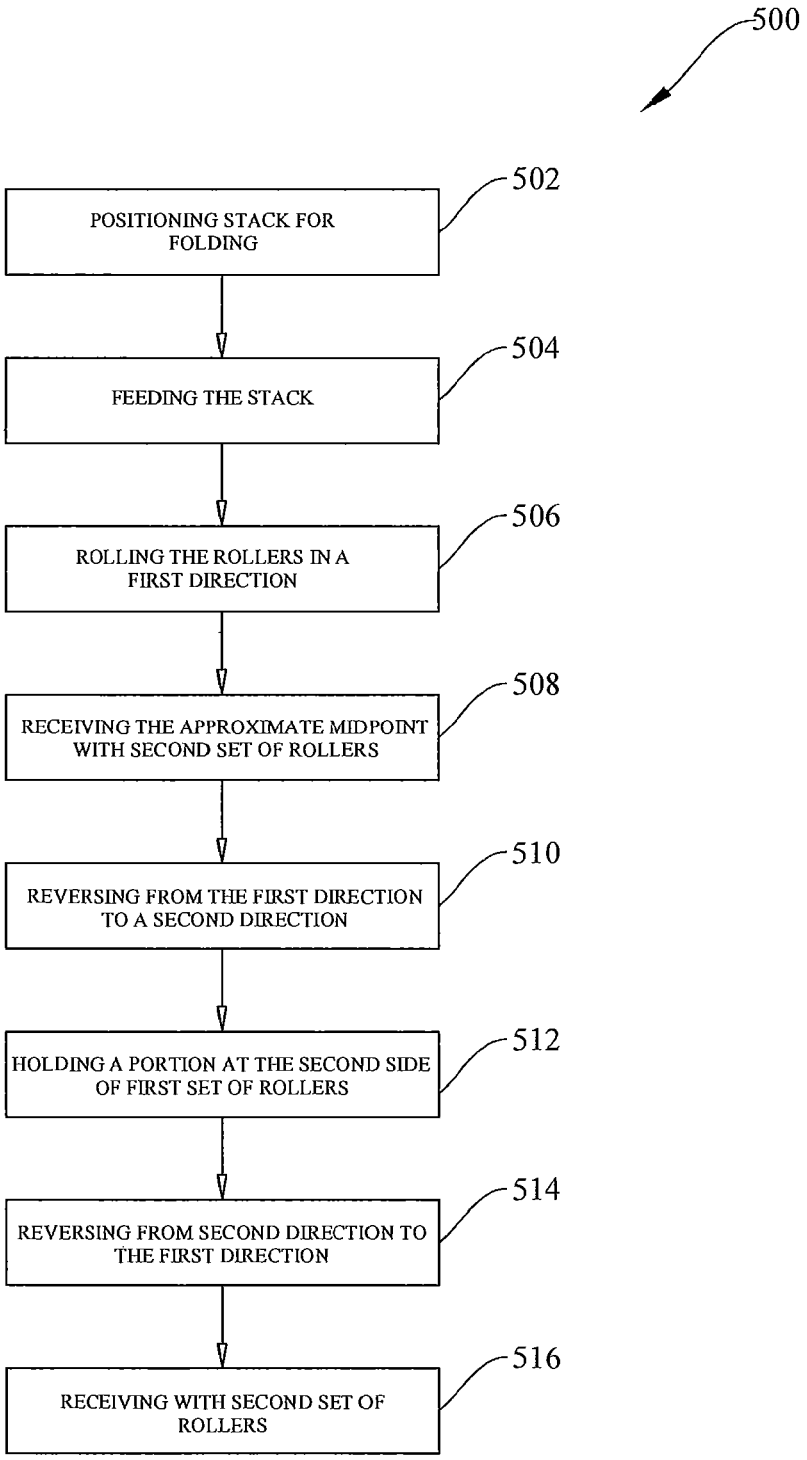
FIG. 5 is a schematic diagram of an embodiment of a method for folding a stack of substrate sheets.

Referring to FIG. 5, the method 500 according to an embodiment is illustrated. In block 502, the method 500 includes positioning the stack of substrate sheets 20 for folding. Referring to FIGS. 2 and 3, the transporting mechanism 10 moves the paper to the positioning mechanism 12 which positions the stack of substrate sheets 20 for folding. At block 504, the method 500 further includes feeding the stack of substrate sheets into the first set of rollers 44, 46. The clamping mechanism 38 continues to hold momentarily the leading edge 30 while the folding blade 40 pushes the stack of substrate sheets 20 until taught. As shown in FIG. 4, when the folding blade 40 reaches a point in horizontal travel such that the midpoint section 42 is impinged between the first set of opposing rollers 44 and 46 at the contact line therebetween, a signal from a position sensor 48 causes release of the clamping mechanism 38 and activates the servo drive mechanism for the first pair of rollers 44, 46 to begin rotating. The position sensor 48 senses when the folding blade 40 has extended outwardly, The position sensor 48 detects the proximity of the folding blade 40 to the position sensor 48. In an example embodiment, the folding blade 40 may have a magnet disposed thereon. In this example embodiment, the position sensor 48 is configured to detect the proximity of the magnet and therefore the presence of the folding blade 40. In an example embodiment, the position sensor is a Hall effect sensor. Additional position sensors (not shown) are disposed in the roller assembly 14 to determine a position of the stack of substrate sheets 20. Signals from these position sensors and position sensor 48 are sent to a controller unit 49. The controller unit is configured to direct the direction and speed of the servo drives for the sets of opposing rollers and other actuators for the clamping mechanism 38, the folding blade 40. In some embodiments, the controller unit 49 includes an Allen Bradley PLC (Programmable Logic Controller) operating ControlLogix software. The controller unit 49 may also include other circuitry and memory circuits. The controller unit 49 can also include a processor.

Upon the position sensor 48 signaling that the folding blade 40 has extended outwardly from an end of the transporting mechanism 10 into the roller assembly 14, the folded midpoint section 42 is drawn into and through the first set of opposing rollers 44 and 46 by rotation in a first direction. The actuating mechanism for the folding blade 40 then retracts the folding blade 40 to its original, unextended position so as not to impede the folding of the stack of substrate sheets 20 between the first set of opposing rollers 44, 46.

At block 506, the method 500 includes rolling the first set of rollers 44, 46 in a first direction to receive the approximate folded midpoint section 42 of the stack of substrate sheets 20 from a first side to move the stack of substrate sheets 20 in the first direction and passing the stack of substrate sheets 20 to the second set of rollers 50, 52. Referring to block 508, the second set of rollers 50, 52 receives the approximate midpoint section 42 at a first side of the second set of rollers 50, 52 from a second side of the first set of rollers 44, 46. As shown in FIG. 7, the first set of opposing rollers 44, 46 continue to rotate to move the stack of substrate sheets 20 in the first direction until the folded midpoint section 42 of the stack of substrate sheets 20 is inserted into the second set of opposing rollers 50 and 52. The distance between the contact point between the first set of opposing rollers 44 and 46, and the contact point between the second set of opposing rollers 50 and 52 is, in some embodiments, less than a desired folded length of the stack of substrate sheets 20. Thus, during operation of the roller assembly 14, in these embodiments, the folded stack of substrate sheets 20 will, in general, be secured between at least one set of opposing rollers 44, 46; 50, 52; or 56, 58 during the folding process. The third pair of opposing rollers 56, 58 will be described in greater detail with reference to FIG. 6 below.

The upper rollers 44, 50 and 56 are part of an upper section of the roller assembly 14 and the lower rollers 46, 52, 58 are part of a lower section of the roller assembly 14. The upper section and lower section of the roller assembly 14 each have a roller servo drive to rotate the rollers in a desired direction. A single servo drive may control both roller sections through proper gearing. Since each set of opposing rollers has a roller that rotates in a counterclockwise direction and a roller that rotates in a clockwise direction, as used herein, "first direction" will refer to the direction that the set of rollers rotate so as to push/roll the stack of substrate sheets 20 away from the transport mechanism 10 toward an exit of the roller assembly 14 and "second direction" will refer to the direction that the set of rollers (acting together/conjunctively) push/roll the stack of substrate sheets 20 towards the transport mechanism 10.

Figure 8:
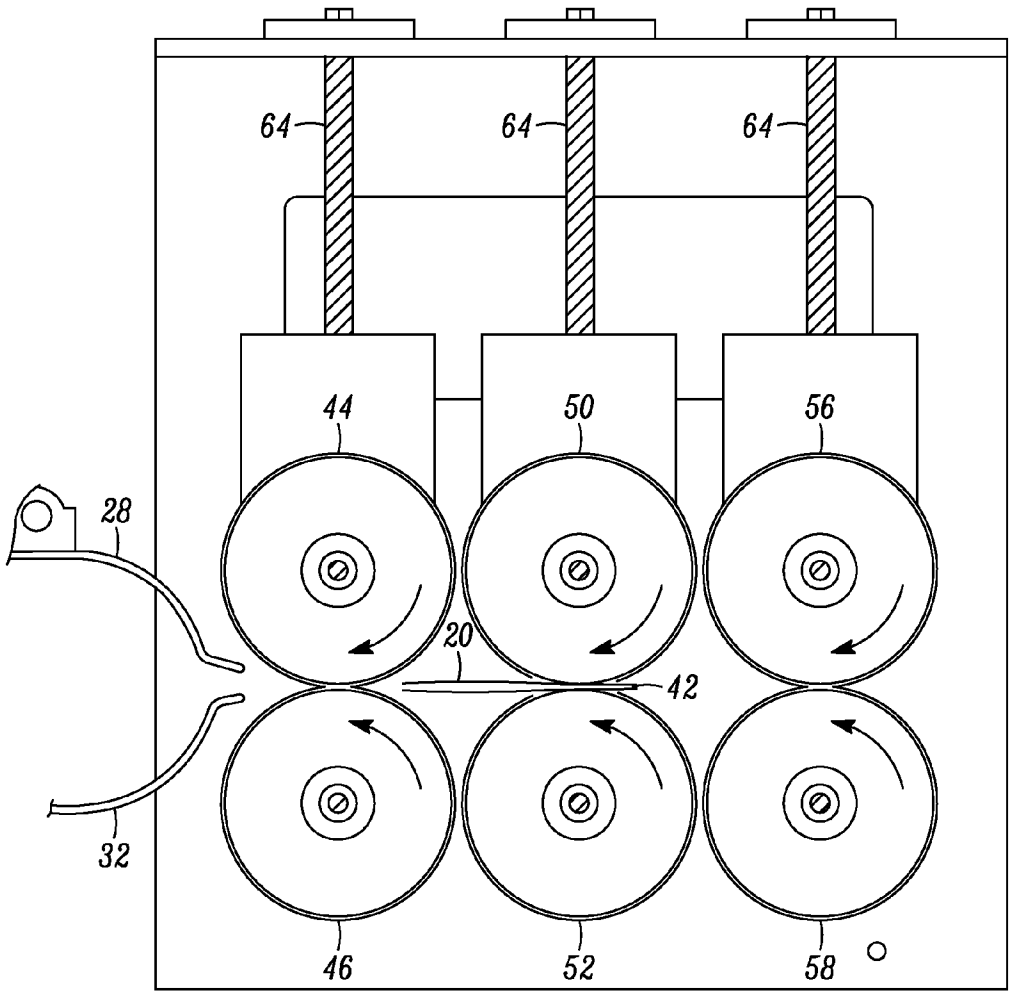
FIG. 8 is a partial cross-sectional side view of an embodiment of the roller assembly with a stack of substrates between the first and second sets of rollers rotating in a second direction.

At block 510, the method 500 includes reversing from the first direction and rolling the first and second sets of rollers 44, 46 and 50, 52 in the second direction. Referring to FIG. 8, once the folded midpoint section 42 of stack 20 passes through the second set of opposing rollers 50, 52, the roller servo drive reverses the direction of rotation to push the folded midpoint section 42 back through the contact point of the second set of opposing rollers 50, 52. At block 512, the method 500 includes holding an open end 54 of the stack of substrate sheets 20 with the first set of rollers 44, 46. In an example embodiment, holding the open end 54 includes preventing the stack of substrate sheets 20 from passing completely past, e.g., from the first, receiving side, to the second, exit side, the respective set of rollers. However, the stack of substrate sheets 20 can still move in the rollers but cannot be released from the roller adjacent the open end 54 of the stack 20. The passing of the folded midpoint section 42 back through the contact point of the second set of opposing rollers 50, 52 applies pressure again to the folded midpoint section 42, during which the open end 54 of the folded stack of substrate sheets 20 is impinged by the first set of opposing rollers 44, 46.

Figure 9:
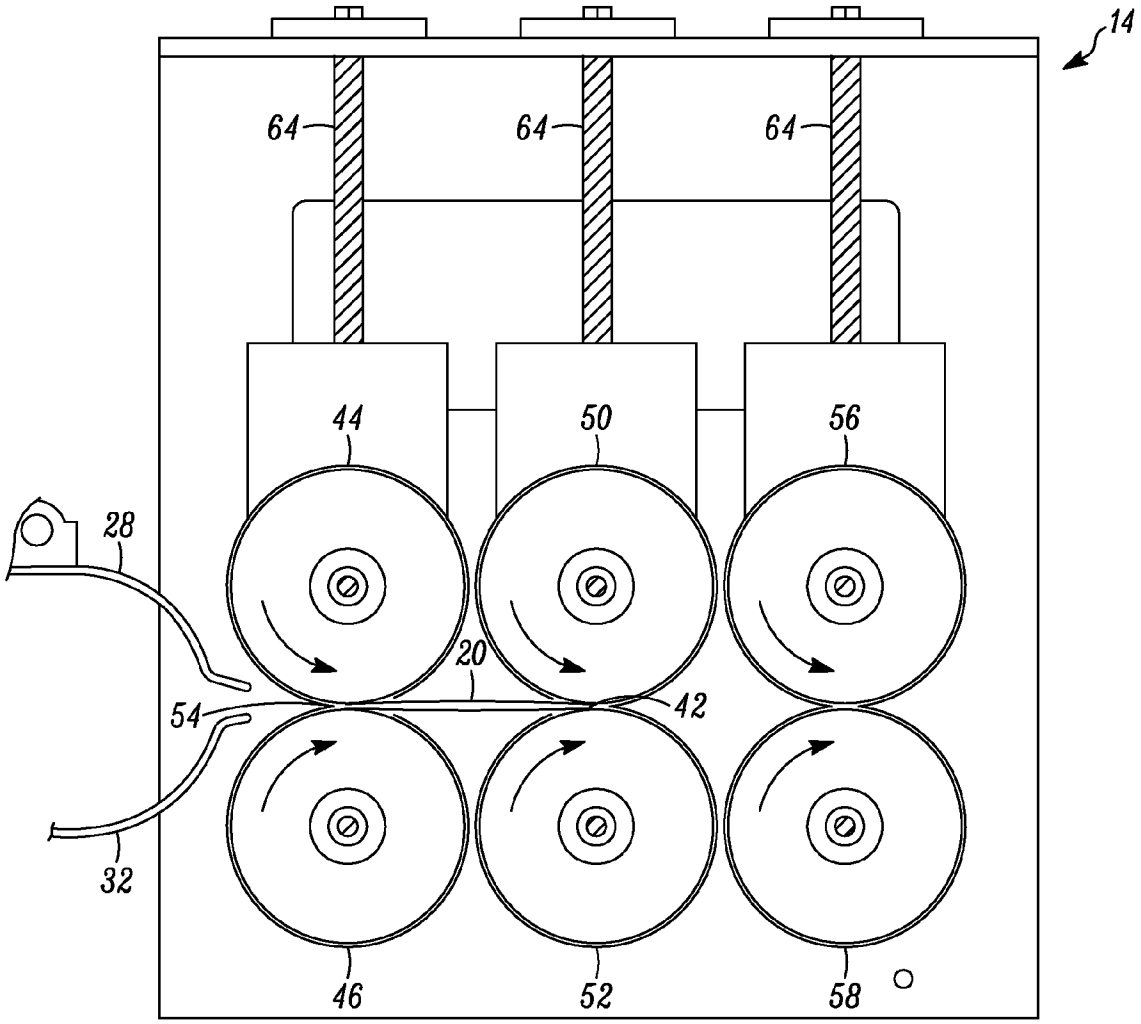
FIG. 9 is a partial cross-sectional side view of an embodiment of the roller assembly with a stack of substrates between the first and second sets of rollers rotating in the first direction.

At block 514, the method 500 includes reversing from the second direction of rotation and rolling the first and second sets of rollers 44, 46 and 50, 52 in the first direction to pass the stack of substrate sheets 20 to the second set of rollers 50, 52. That is, referring to FIG. 9, the roller servo drive rotates the first and second sets of rollers 44, 46 and 50, 52 in the first direction so that the folded midpoint section 42 again passes through the second set of opposing rollers 50, 52

At block 516, the method 500 includes receiving the open end 54 at a first side of the second set of rollers 50, 52 and rolling the stack of substrate sheets 20 to a second side of the second set of rollers 50, 52. After exiting the second side (downstream) of the second set of rollers 50, 52, the stack of substrate sheets 20, now folded, can be picked up for insertion into a shipping container or further transported for insertion into a shipping container. In a further example, the further transportation can be insertion into a second transporting mechanism 10 and roller mechanism 14 for a further folding operation as described herein.

Figure 6:
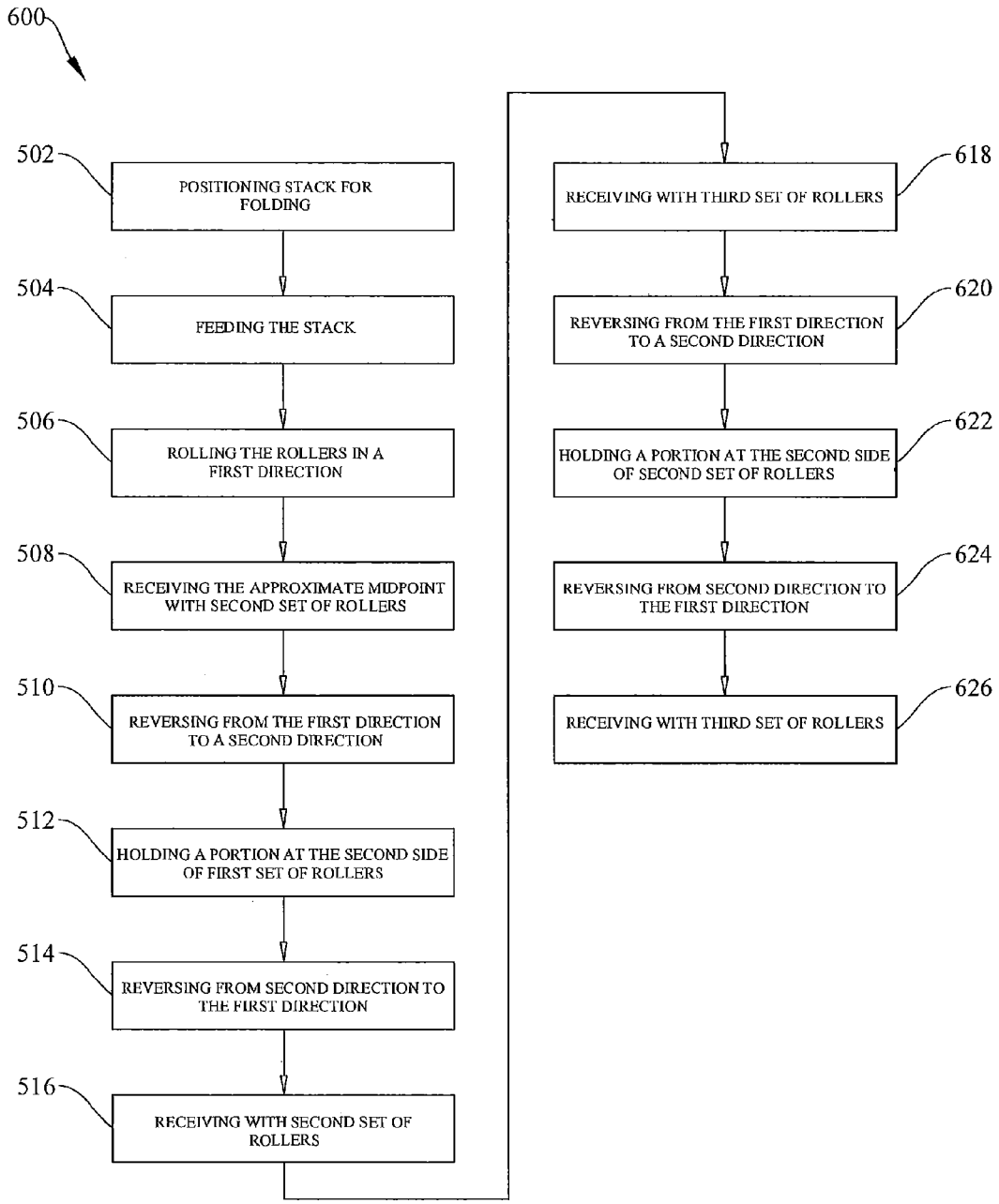
FIG. 6 is a schematic diagram of an embodiment of a method for folding a stack of substrate sheets.
Figure 7:
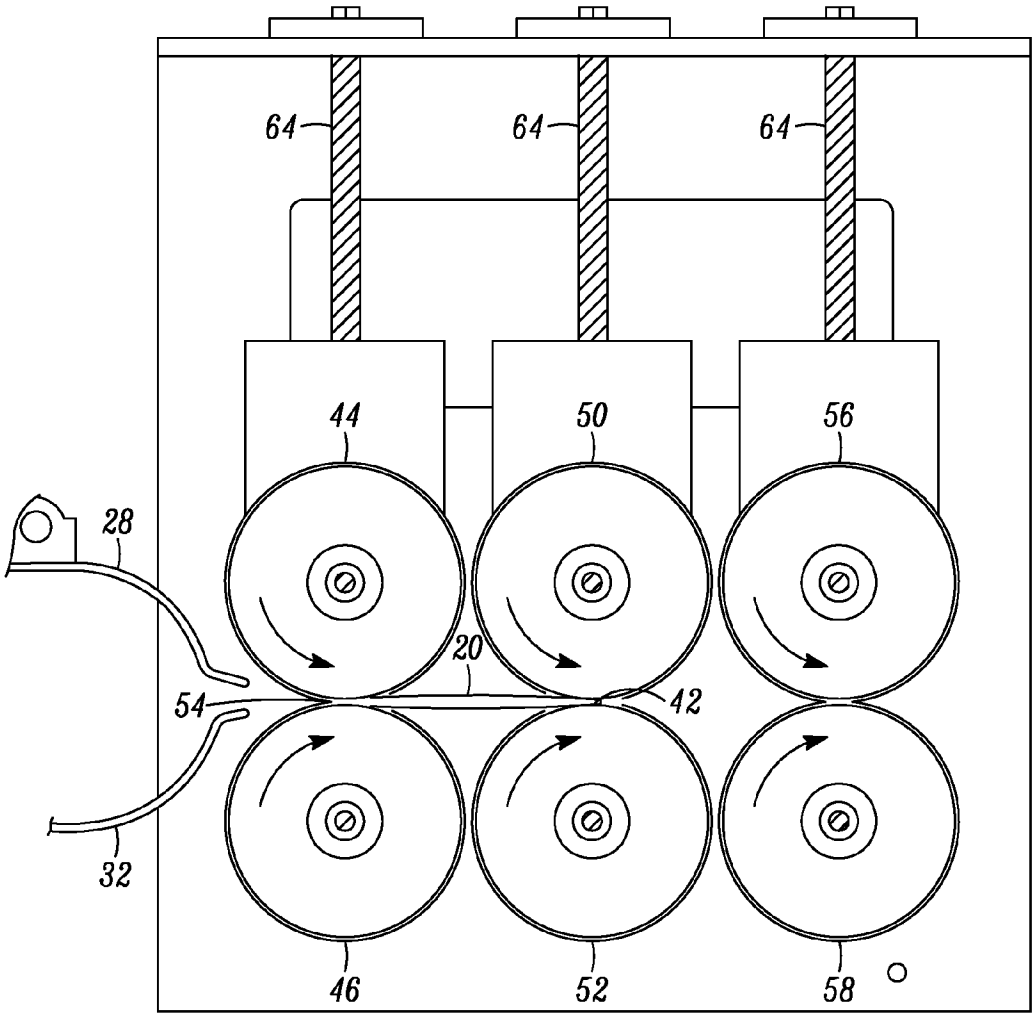
FIG. 7 is a partial cross-sectional side view of an embodiment of a roller assembly with a stack of substrates between first and second sets of rollers rotating in a first direction.

Referring now to FIG. 6, a method 600 in accordance with another embodiment of a method 600 for folding a stack of substrate sheets 20 will now be explained. In view of the similarity between the embodiments, the blocks of the method 600 that are identical to the blocks of the method 500 will be given the same reference numerals as the blocks of the method 500. Moreover, a description of the blocks that are identical may be omitted for the sake of brevity.

Figure 10:
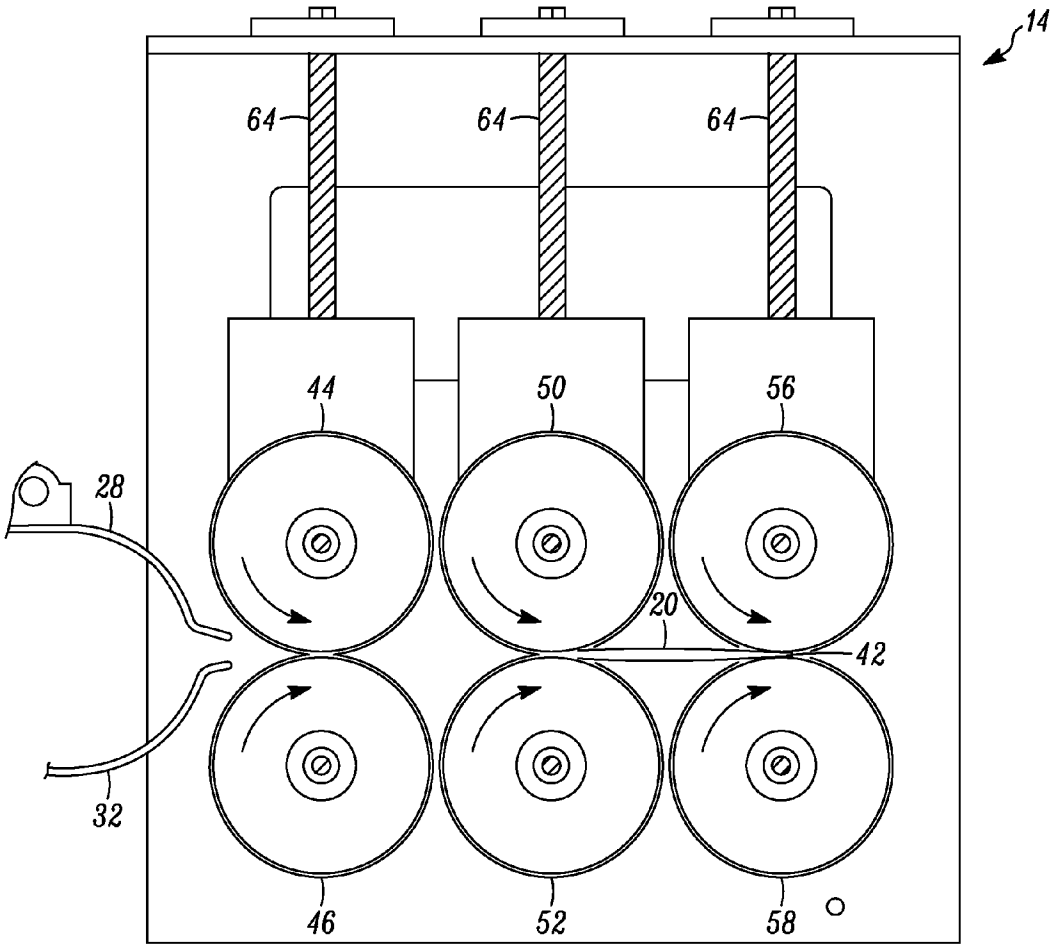
FIG. 10 is a partial cross-sectional side view of an embodiment of the roller assembly with a stack of substrates between the second and third sets of rollers rotating in a first direction.

The folded midpoint section 42 passes through the third set of rollers 56, 58 after block 516. That is, at block 618, the method 600 includes receiving the approximate folded midpoint section 42 from a first side of the third set of rollers 56, 58, as shown in FIG. 10.

Figure 11:
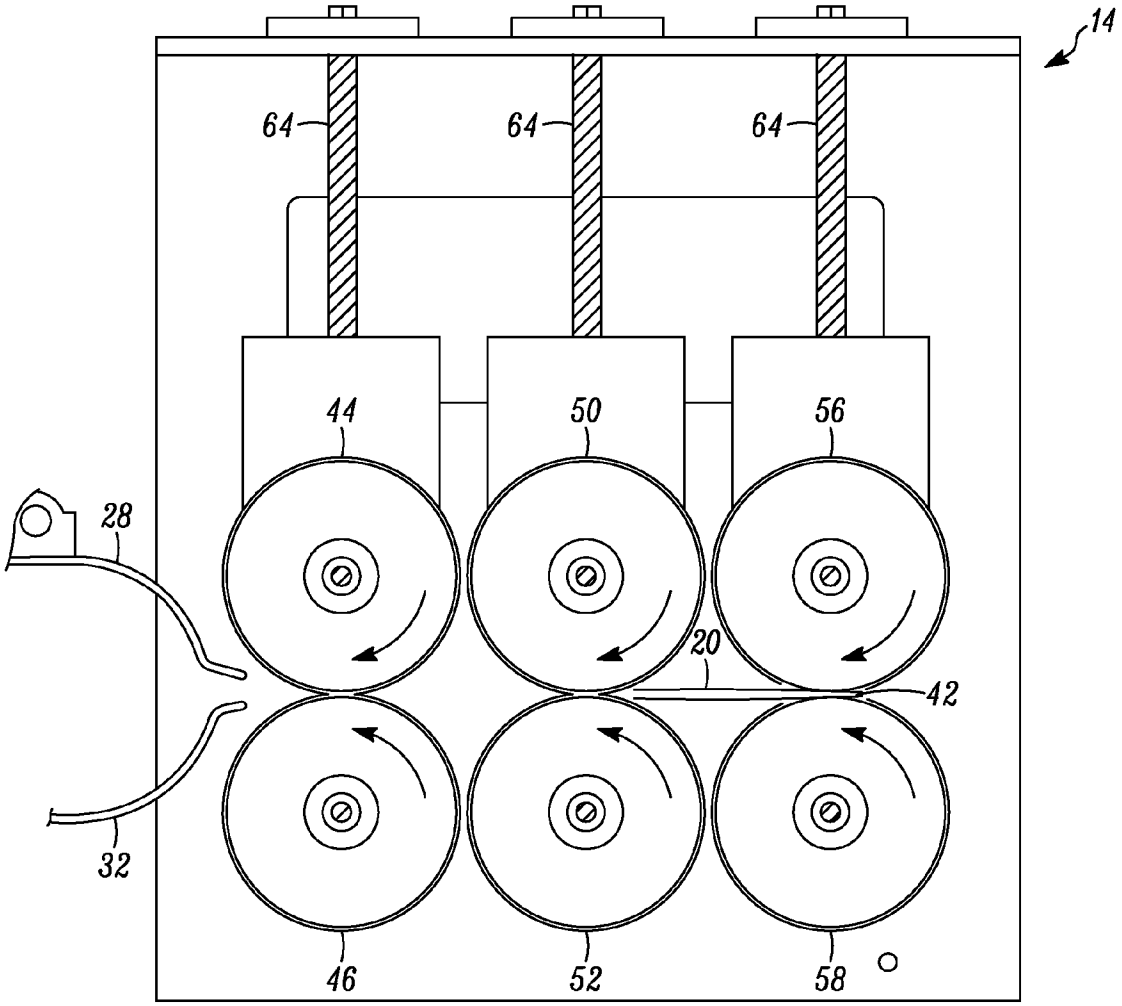
FIG. 11 is a partial cross-sectional side view of an embodiment of the roller assembly with a stack of substrates between the second and third sets of rollers rotating in a second direction.

At block 620, the method 600 includes reversing from the first direction and rolling the second and third sets of rollers 50, 52, 56, 58 in the second direction. Referring to FIG. 11, once the folded midpoint section 42 passes through the third set of opposing rollers 56, 58, the roller servo drive reverses the direction of rotation until the folded midpoint section 42 passes back through the contact point of the third set of opposing rollers 56, 58. At block 622, the method 600 includes holding the open end 54 of the stack of substrate sheets 20 with the second set of rollers 50, 52. The passing of the folded midpoint section 42 back through the contact point of the third set of rollers 56, 58 applies pressure again to the folded midpoint section 42, during which the open end 54 of the folded stack of substrate sheets 20 is impinged by the second set of opposing rollers 50, 52.

Figure 12:
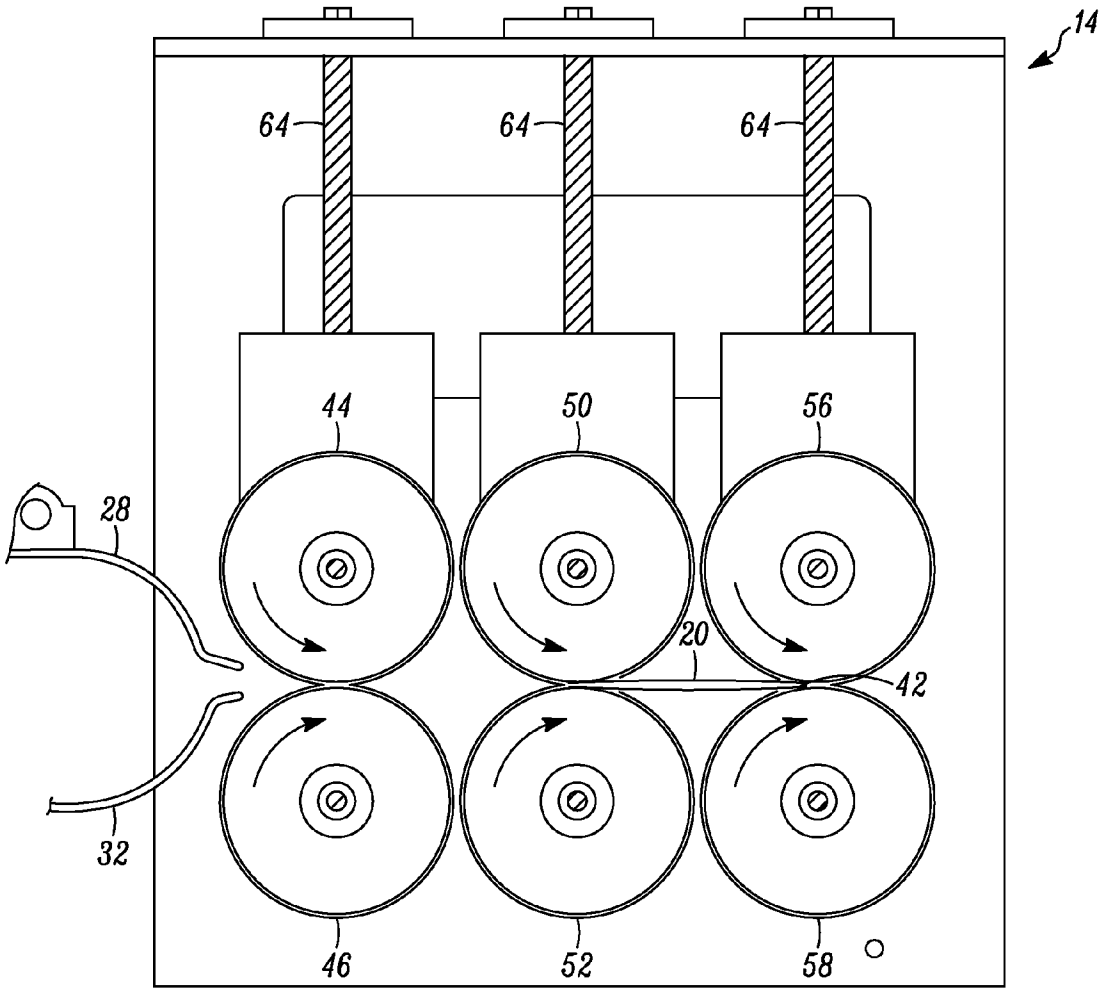
FIG. 12 is a partial cross-sectional side view of an embodiment of the roller assembly with a stack of substrates between the second and third sets of rollers rotating in the first direction.
Figure 13:
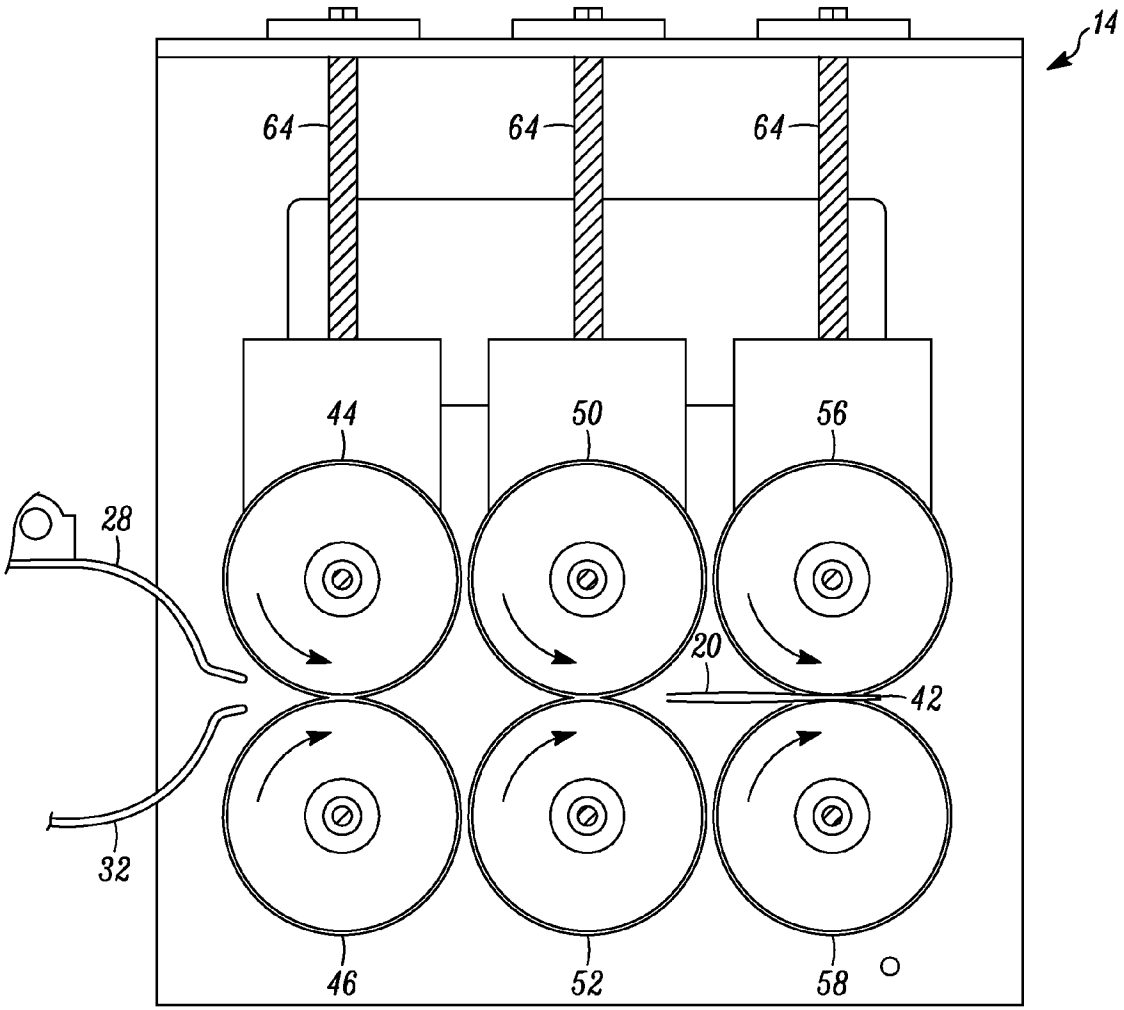
FIG. 13 is a partial cross-sectional side view of an embodiment of the roller assembly with a stack of substrates leaving the second set of rollers and passing through the third set of rollers.

FIG. 12 illustrates the position of the impinged open end 54 at the time of reversal in block 624. At block 624, the method 600 includes reversing from the second direction and rolling the second and third sets of rollers 50, 52, 56, 58 in the first direction to pass the stack of substrate sheets 20 in the first direction. The roller servo drive rotates the second and third set of opposing rollers 50, 52, 56, 58 in the first direction. At block 626, the method 600 includes receiving the approximate folded midpoint section 42 with the third set of rollers 56, 58 at a first side and passing the stack of substrate sheets 20 to a second side of the third set of rollers 56, 58. Referring to FIG. 13, the folded midpoint section 42 of the stack of substrate sheets 20 again passes through the third set of opposing rollers 56 and 58.

Figure 14:
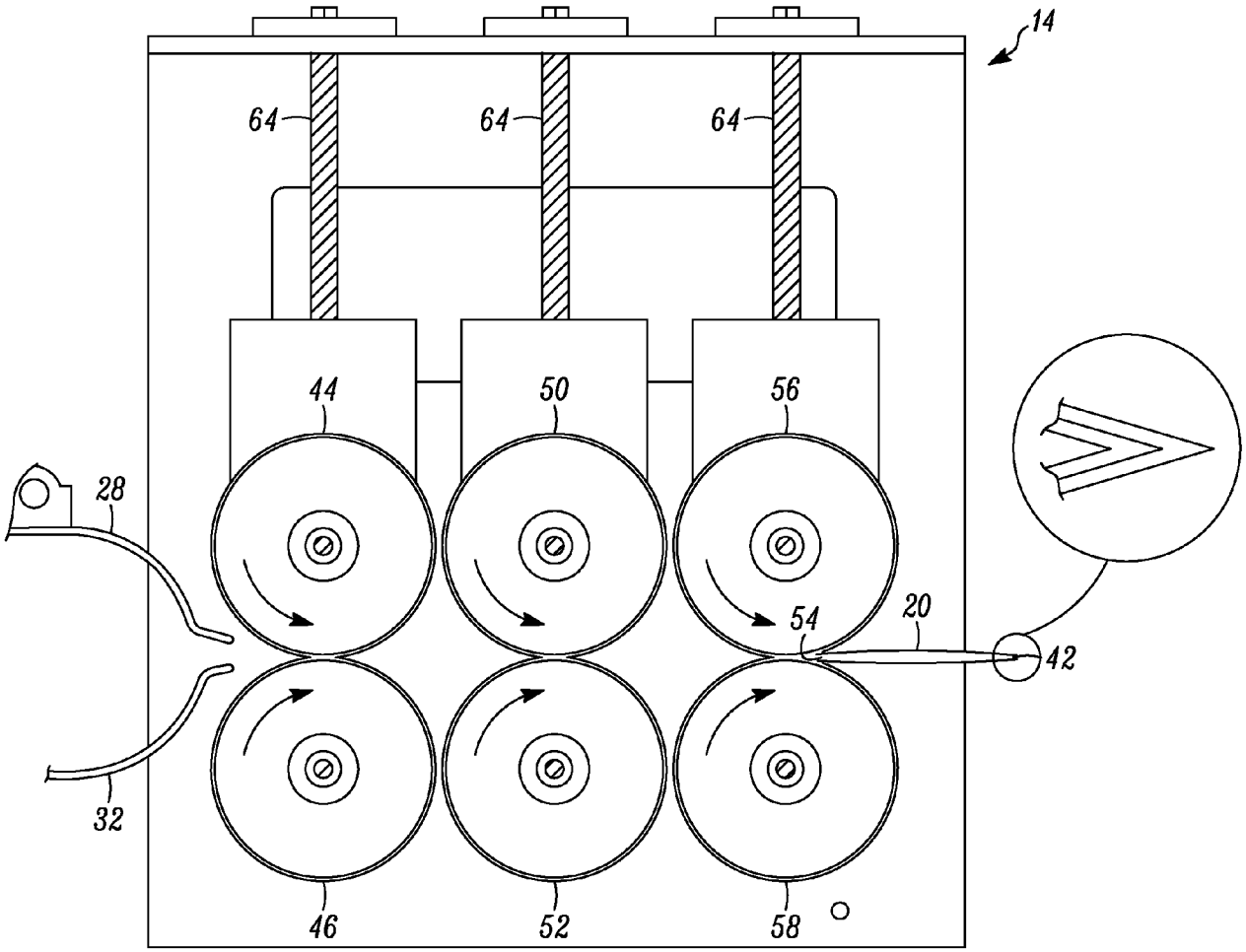
FIG. 14 is a partial cross-sectional side view of an embodiment of the roller assembly with an open end of a stack of substrates leaving the third set of rollers.

Referring to FIG. 14, the open end 54 of the stack of substrate sheets 20 passes through the third set of opposing rollers 56, 58 and the fully folded stack of substrate sheets 20 is expelled from the roller assembly 14. The method 600 may be repeated after the stack of substrate sheets 20 are expelled from the roller assembly. In some embodiments, the feeding into the first set of rollers 44, 46, as described at block 504, of a subsequent stack of substrate sheets 20 may begin at, for example, block 624, e.g., when the second and third sets of rollers 50, 52, 56, 58 are rolling in the first direction a second time.

The rotation and reversal of rotation described above staggers the stack of substrate sheets 20 to provide a staggered folded configuration and provides a more stable fold that prevents the stack 20 from springing back into its approximate original form after folding. In some embodiments, a system and method with sets of rollers in addition to the two or three sets may be utilized to fold of thicker stacks, for example. Thus, the number of sets of rollers can be two or greater and remain within the scope of the present disclosure. The multiple passes of the stack of substrate sheets 20 through the pairs of rollers 44, 46; 50, 52; and 56, 58 in at least two directions provides a stable fold that has a reduced tendency to unfold by itself or spring back to its original position.

In some embodiments, the rollers 44, 46, 50, 52, 56, 58 may have annular grooves 60 along an outer diameter and an o-ring 62 as a contact ring seated within each of the annular grooves to give traction to the rollers. The o-rings 62 are sized and configured to snugly fit in the grooves 60 and grasp the stack of substrate sheets 20. The roller assembly 14 can also include springs 64 that apply a downward force onto axels of the rollers. The springs 64 press the rollers 44, 50, 56 against the corresponding opposing rollers 46, 52, 58. As stacks of substrate sheets 20 of varying thickness, containing various numbers of sheets, pass through the roller assembly 14, the springs 64 adjust the force on the rollers so that each stack 20 receives a tailored force based on the number of sheets to provide an optimum fold. In an example embodiment, the springs 64 exert an essentially constant force on the rollers 44, 50, 56 but allow the rollers 44, 50, 56 to travel away from the opposing rollers 46, 52, 58 to allow different thicknesses of stacks 20 to travel between the sets of rollers 44, 46; 50, 52; and 56, 58.

The second set of opposing rollers 50, 52 is juxtaposed next to the first pair of opposing rollers 44, 46. The sets of rollers 44, 46; 50, 52; and 56, 58 are positioned in the direction of travel of the folded stack 20 such that at any one time during travel of the stack at least one pair of rollers 44, 46; 50, 52; and 56, 58 grip the stack of substrate sheets 20 therebetween. In an example embodiment, the rollers are cylinders with their axels being spaced apart less than the length (in the direction of travel) of the folded stack of substrate sheets 20. In a further example embodiment, the radius of each roller pairs 44, 46; 50, 52; and 56, 58 is less than half the length of the folded stack of substrate sheets 20. This allows the roller pairs 44, 46; 50, 52; and 56, 58 to be spaced from each other and have at least one roller pair 44, 46; 50, 52; or 56, 58 to engage the folded stack of substrate sheets 20.

In some embodiments, the method includes positioning the stack of substrate sheets for folding; feeding the stack of substrate sheets into a first set of rollers by driving an approximate midpoint section of the stack toward a contact point of the first set of rollers; rolling the rollers in a first direction to receive the approximate midpoint section of the stack of substrate sheets from a first side and passing the stack of substrate sheets to a second set of rollers to fold at the approximate midpoint section; receiving the folded approximate midpoint section of the stack of substrate sheets from the first side with the second set of rollers; reversing from the first direction and rolling the first and second sets of rollers in a second direction; holding an open end of the stack of substrate sheets with the first set of rollers at the second side of the first set of rollers; reversing from the second direction and rolling the first and second sets of rollers in the first direction; and receiving the folded approximate midpoint section at contact point of the second set of rollers and passing the stack of substrate sheets to a second side of the second set of rollers.

In some embodiments, the system includes a roller assembly and a positioning mechanism. The roller assembly is configured for folding the stack of substrate sheets and the positioning mechanism is configured to position the substrate for entry into the roller assembly. The positioning mechanism includes an upper curved form and a lower curved form to guide the stack of substrate sheets into a curved position for folding. The positioning mechanism further includes a folding blade positioned to extend through an elongated aperture between the upper and lower curved forms.

GENERAL INTERPRETATION OF TERMS

In understanding the scope of embodiments of the present invention, the term "comprising" and its derivatives, as used herein, are intended to be open ended terms that specify the presence of the stated features, elements, components, groups, and/or steps, but do not exclude the presence of other unstated features, elements, components, groups, and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe embodiments of the present invention, the following directional terms "forward, rearward, above, downward, vertical, horizontal, below and transverse" as well as any other similar directional terms refer to those directions of the system 1 and method 500, 600 in a normal operating position. As used herein, "a" or "an" may reflect a single part or multiple parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. Other ranges of deviation may be within the scope of the embodiments of the present invention. For example, a reasonable amount of deviation may be that which produces the Chevron type folded stack as described herein. That is, a 1-10% deviation from the midpoint 42 of the stack of substrate sheets 20 is within the scope of the embodiments of the present invention.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A method for folding a stack of substrate sheets comprising:

positioning a stack of non-continuous substrate sheets for folding from an aperture in a curved form;

feeding the stack of substrate sheets into a first set of rollers by driving an approximate midpoint section of the stack toward a contact point of the first set of rollers;

rolling the first set of rollers to receive the approximate midpoint section of the stack of substrate sheets from the feeding at a first side of the first set of rollers and passing the stack of substrate sheets to a second set of rollers in a first direction to fold the stack of substrate sheets at the approximate midpoint section to form a closed end of the folded stack of substrate sheets and an open end of the folded stack of substrate sheets;

receiving the folded approximate midpoint section of the stack of substrate sheets from rolling the first set of rollers at a first side of the second set of rollers with the second set of rollers;

reversing from the first direction and rolling the first and second sets of rollers to cause the stack of substrate sheets to travel in a second direction such that the open end of the stack of substrate sheets is received at a second side of the first set of rollers;

stopping the first set of rollers to hold the open end of the stack of substrate sheets with the first set of rollers after receiving the stack of substrate sheets at the second side of the first set of rollers;

reversing from the second direction and rolling the first and second sets of rollers to cause the stack of substrate sheets to travel again in the first direction; and after reversing from the second direction, again receiving the folded approximate midpoint section at a contact point of the second set of rollers and passing the stack of substrate sheets to a second side of the second set of rollers.

2. The method of claim 1, wherein the feeding includes sliding a folding blade to push the approximate midpoint section to begin folding of the stack of substrate sheets.

3. The method of claim 1, further comprising:

receiving the folded approximate midpoint section with a third set of opposing rollers from the second set of opposing rollers.

4. The method of claim 3, further comprising:

rotating the second and third set of rollers to draw the folded approximate midpoint section of the stack of substrate sheets through the third set of rollers.

5. The method of claim 4, further comprising:

reversing from the first direction of travel of the stack of substrate sheets and rolling the second and third sets of rollers to cause the stack of substrate sheets to travel in the second direction to draw at least the folded approximate midpoint of the stack of substrate sheets through the third set of rollers.

6. The method of claim 5, further comprising:

holding the open end of the stack of substrate sheets with the second set of rollers.

7. The method of claim 6, further comprising:

reversing from the second direction and rolling the second and third sets of rollers to pass the stack of substrate sheets in the first direction.

8. The method of claim 7, further comprising:

receiving the approximate folded midpoint section with the third set of rollers at a first side of the third set of rollers and passing the stack of substrate sheets to a second side of the third set of rollers.

9. The method of claim 1, wherein the positioning the stack of substrate sheets for folding includes positioning the stack along a concave surface of a pair of curved forms, temporarily securing the stack of substrate sheets to a portion of the concave surface of the pair of curved forms, and releasing the stack when the approximate midpoint section is between the first set of rollers.

10. A system for folding substrate sheets comprising:

a roller assembly configured to fold a stack of substrate sheets, the roller assembly including a first set of opposing rollers and a second set of opposing rollers juxtaposed with the first set of opposing rollers, the first and second sets of opposing rollers being configured and arranged to rotate to draw at least a portion of the stack of substrate sheets through the first and second sets of opposing rollers, the roller assembly further including a third set of opposing rollers downstream from the second set of opposing rollers; and a positioning mechanism configured to position the stack of substrate sheets for entry into the roller assembly, the positioning mechanism including an upper curved form and a lower curved form to guide the stack of substrate sheets into a curved position for folding, the upper and lower curved forms forming an elongated aperture therebetween, the positioning mechanism further including a folding blade slidably positioned to extend through the elongated aperture between the upper and lower curved forms to push the stack of substrate sheets in the curved position toward the roller assembly, wherein the upper curved form includes a first flange adjacent the aperture and extending downwardly and toward the roller assembly, wherein the lower curved form includes a second flange adjacent the aperture and extending upwardly and toward the roller assembly, wherein a controller is programmed to rotate the second and third sets of rollers to draw at least the folded portion of the stack through the second and third sets of opposing rollers, and wherein the second and third sets of opposing rollers are configured and arranged to reverse direction of rotation to draw at least the folded portion of the stack of substrate sheets back through the third set of opposing rollers, and thereafter to reverse the direction of rotation to drive the folded portion of the stack between the third set of opposing rollers.

11. The system of claim 10, wherein the folding blade is configured and arranged to push at least a portion of the stack of substrate sheets through the elongated aperture.

12. The system of claim 10, wherein the upper curved form has a first concave side facing away from the roller assembly and configured for deflecting the stack while guiding the stack into the curved position for folding with the stack being in contact with the first concave side, wherein the lower curved form has a second concave side facing away from the roller assembly and configured for deflecting the stack of substrate sheets while guiding the stack of substrate sheets into the curved position for folding with the stack of substrate sheets being in contact with the second concave side, and wherein the second flange extends away from the second concave side in a direction of travel of the stack of substrate sheets through the aperture.

13. The system of claim 10, wherein the first and second set of opposing rollers are configured to:

receive the stack of substrate sheets into the first set of rollers by sending an approximate midpoint section of the stack of substrate sheets toward a contact point of the first set of rollers;

roll the first set of rollers to receive the approximate midpoint section of the stack of substrate sheets from the feeding at a first side of the first set of rollers;

pass the stack of substrate sheets from the first set of rollers to the second set of rollers in a first direction to fold the stack of substrate sheets at the approximate midpoint section to form a closed end of the folded stack of substrate sheets and an open end of the folded stack of substrate sheets;

receive the folded approximate midpoint section of the folded stack of substrate sheets from rolling the first set of rollers at a first side of the second set of rollers with the second set of rollers;

reverse from the first direction and roll the first and second sets of rollers to cause the folded stack of substrate sheets to travel in a second direction such that the open end of the folded stack of substrate sheets is received at a second side of the first set of rollers;

stop the first set of rollers to hold the open end of the folded stack of substrate sheets with the first set of rollers after receiving the folded stack of substrate sheets at the second side of the first set of rollers;

reverse from the second direction and roll the first and second sets of rollers to cause the folded stack of substrate sheets to travel again in the first direction; and after reversing from the second direction, receive again the folded approximate midpoint section at a contact point of the second set of rollers and pass the folded stack of substrate sheets to a second side of the second set of rollers.

14. The system of claim 10, wherein the first flange extends downwardly toward the aperture to narrow the aperture in a travel direction of the stack of substrate sheets through the aperture and the second flange extends upwardly toward the aperture to narrow the aperture in the travel direction of the stack of substrate sheets through the aperture.

15. The system of claim 10, wherein the stack of substrate sheets is a stack of printed papers.

16. A system for folding substrate sheets comprising:

a roller assembly configured to fold a stack of substrate sheets; and a positioning mechanism configured to position the substrate for entry into the roller assembly, the positioning mechanism including an upper curved form and a lower curved form to guide the stack of substrate sheets into a curved position for folding, the upper and lower curved forms forming an elongated aperture therebetween, the positioning mechanism further including a folding blade slidably positioned to extend through the elongated aperture between the upper and lower curved forms to push the stack of substrate sheets in the curved position toward the roller assembly and a clamping mechanism proximate one of the upper and lower curved forms to secure the stack of substrate sheets to a portion of a concave surface of the upper and lower curved forms, wherein the upper curved form includes a first flange adjacent the aperture and extending downwardly and toward the roller assembly, and wherein the lower curved form includes a second flange adjacent the aperture and extending upwardly and toward the roller assembly, wherein the clamping mechanism is configured to release the stack of substrate sheets after the folding blade extends through the elongated aperture.

17. The system of claim 16, wherein the roller assembly includes a first set of opposing rollers and a second set of opposing rollers juxtaposed with the first set of opposing rollers, the first and second sets of opposing rollers being configured and arranged to rotate to draw at least a portion of the stack of substrate sheets through the first and second sets of opposing rollers, the roller assembly further including a third set of opposing rollers downstream from the second set of opposing rollers, the first set of opposing rollers includes two rollers that always rotate in opposite directions when moving the stack of substrate sheets, wherein the second set of opposing rollers includes two rollers that always rotate in opposite directions when moving the stack of substrate sheets, wherein the second and third sets of rollers are configured and arranged to reverse direction of rotation to draw at least the folded portion of the stack back through the third set of rollers, and thereafter to reverse the direction of rotation to drive the folded portion of the stack between the third set of opposing rollers, and wherein a controller is programmed to control rotation of the first, second, and third sets of rollers.

18. A method for folding a stack of substrate sheets comprising:

feeding a stack of substrate sheets into a form;

pressing the stack of substrate sheets through a gap in the form to form a folded end of the stack;

receiving the stack of substrate sheets between a first set of opposing rollers with the folded end being initially received by the first set of opposing rollers;

moving the folded end of the stack of substrate sheets in a first direction between the first set of opposing rollers from a receive side to an exit side;

receiving the folded end of the stack of substrate sheets between a second set of opposing rollers from a receive side;

moving the stack of substrate sheets in the first direction so that the folded end moves past the second set of opposing rollers with at least a part of the stack of substrate sheets remaining in the first set of opposing rollers;

after moving the stack of substrate sheets, stopping the first and second set of opposing rollers with the folded end being downstream and free of the second set of opposing rollers;

reversing direction of the stack of substrate sheets to a second direction by reversing rotation of the first and second set of opposing rollers so that the folded end moves past the receive side of the second set of opposing rollers with at least a part of the stack of substrate sheets remaining in the first set of opposing rollers;

moving the stack of substrate sheets in the first direction so that the folded end moves past the second set of opposing rollers; and further moving the stack of substrate sheets in the first direction so that the free end moves past the first set of opposing rollers.

19. The method of claim 18, wherein the first set of opposing rollers includes two rollers that always rotate in opposite directions when moving the stack of substrate sheets and wherein the second set of opposing rollers includes two rollers that always rotate in opposite directions when moving the stack of substrate sheets.

20. A method for folding a stack of substrate sheets comprising:

positioning a stack of non-continuous substrate sheets for folding from an aperture in a curved form;

feeding the stack of substrate sheets into a first set of rollers by driving an approximate midpoint section of the stack toward a contact point of the first set of rollers;

driving the first set of rollers to receive the approximate midpoint section of the stack of substrate sheets from the feeding at a first side of the first set of rollers and passing the stack of substrate sheets to a second set of rollers in a horizontal, first direction to fold the stack of substrate sheets at the approximate midpoint section to form a closed end of the folded stack of substrate sheets and an open end of the folded stack of substrate sheets;

receiving the folded approximate midpoint section of the stack of substrate sheets from rolling the first set of rollers at a first side of the second set of rollers;

driving the first and second sets of rollers to reverse the stack of substrate sheets from the first direction to travel in a horizontal, second direction such that the open end of the stack of substrate sheets is received at a second side of the first set of rollers and the folded approximate midpoint section passing from the second set of rollers;

driving the first and second sets of rollers to reverse the stack of substrate sheets from the second direction to the first direction with the first set of rollers having the stack of substrate sheets therebetween to cause the stack of substrate sheets to travel again in the first direction; and after the first and second sets of rollers reverse the stack of substrate sheets from the second direction to the first direction, again receiving the folded approximate midpoint section at a contact point of the second set of rollers and passing the stack of substrate sheets to a second side of the second set of rollers.

21. The method of claim 20, wherein the driving the first and second sets of rollers to reverse the stack of substrate sheets from the first direction to travel in a second direction includes receiving the stack of substrate sheets at the second side of the first set of rollers before driving to cause the stack of substrate sheets to travel again in the first direction.

* * * * *